United States Patent [19]

Oikawa

[11] 4,248,947

[45] Feb. 3, 1981

[54] METHOD FOR MASTER PATTERN PRODUCTION

[75] Inventor: Mitsuru Oikawa, Tokyo, Japan

[73] Assignee: Hitachi, Ltd., Japan

[21] Appl. No.: 852,979

[22] Filed: Nov. 18, 1977

[30] Foreign Application Priority Data

| | | | |
|---|---|---|---|
| Dec. 1, 1976 | [JP] | Japan | 51-143333 |
| Dec. 1, 1976 | [JP] | Japan | 51-143334 |
| Dec. 1, 1976 | [JP] | Japan | 51-143335 |
| Jan. 10, 1977 | [JP] | Japan | 52-834 |

[51] Int. Cl.[3] ..... G03C 5/00; G03C 5/06

[52] U.S. Cl. ..... 430/5; 430/23; 430/24; 430/321

[58] Field of Search ..... 96/36.1, 36, 44; 313/364; 156/644; 430/24, 23, 5, 321

[56] References Cited

U.S. PATENT DOCUMENTS

| | | | |
|---|---|---|---|
| 3,558,310 | 1/1971 | Mayaud | 96/36.1 |
| 3,615,461 | 10/1971 | Kaplan | 430/24 |
| 3,615,461 | 10/1971 | Kaplan | 96/36.1 |
| 3,615,462 | 10/1971 | Szecho et al. | 430/24 |
| 3,676,914 | 7/1972 | Fiore | 156/644 X |
| 3,698,903 | 10/1972 | Dodd et al. | 430/23 X |
| 3,900,359 | 8/1975 | Bakewell | 96/36.1 X |
| 3,973,964 | 8/1976 | Lange | 96/36.1 |
| 3,975,198 | 8/1976 | Palac et al. | 96/36.1 |
| 3,989,524 | 11/1976 | Palac | 96/36.1 |

*Primary Examiner*—Edward C. Kimlin
*Attorney, Agent, or Firm*—Craig & Antonelli

[57] ABSTRACT

A method for producing a master pattern used for manufacture of a color picture tube phosphor screen is disclosed. An image of an interchangeable shadow mask is formed on the internal surface of the face glass and transferred onto a photosensitive plate, thereby producing a master pattern with a very high accuracy. In the case of a very thin photosensitive plate, the master pattern is produced directly from the interchangeable shadow mask. The method for producing a color picture tube by use of a master pattern involves equipment much lower in cost and easier in manufacturing processes than the conventional methods due to the facts that exposure by flood light is possible and that the shadow mask and the face glass need not be handled as a couple.

17 Claims, 15 Drawing Figures

METHOD FOR MASTER PATTERN PRODUCTION

LIST OF PRIOR ART REFERENCES (37 CFR 1.56(a))

The following references are cited to show the state of the art:

U.S. Pat. No. 3,558,310
U.S. Pat. No. 3,794,873
U.S. Pat. No. 3,909,928
Japanese Patent Laid-Open No. 16068/72
Japanese Patent Laid-Open No. 7021/71
Japanese Patent Laid-Open No. 108570/76

BACKGROUND OF THE INVENTION

This invention relates to a method for producing a master pattern, or more in particular to a method for producing a master pattern used for manufacture of the phosphor screen of the color picture tube.

A phosphor screen of a color picture tube in which the spaces around circular, rectangular or striped red, blue and green phosphor dots are filled with such light-absorbing material as carbon is well known. The color picture tube having this type of phosphor screen is generally called a black matrix color picture tube or black surround color picture tube and is presently most widely used due to advantageous features including a bright picture and high contrast.

As apparent from the U.S. Pat. No. 3,558,310, the processes of manufacture of the phosphor screen of the black matrix color picture tube are highly complicated and so are eagerly required to be simplified.

First, a conventional method for producing the phosphor screen of the black matrix color picture tube will be briefly described below.

As shown in FIG. 1, a shadow mask 3' is mounted on a glass face panel 1 having an internal surface coated with photo-resist or phosphor slurry 2 for forming a black matrix, and the assembly is placed on an exposure mount A. In order to harden the photo-resist at the positions of red, blue and green or to apply the phosphors of the corresponding colors to those positions exposure and development are effected by the use of three spot light sources 4, 4' and 4" through a compensating lens 5 and the shadow mask 3'.

Thus, production of a black matrix requires three exposures and one development, and production of phosphor dots requires three exposures and three developments. At each time of exposures and developments, the shadow mask is mounted and removed. The resulting inconvenience is the need for a multiplicity of exposure mounts, and multiple repetitions of a series of complicated processes including application and drying of photo-resist or phosphor slurry, the mounting of a shadow mask exposure, removal of the shadow mask and development. Further, for lack of interchangeability the conventional shadow mask, used for forming the phosphor screen, is incorporated into the color picture tube, so that the face panel and the shadow mask is handled as a couple from the first to the last of the above-mentioned complicated series of processes, resulting in great practical inconveniences.

For simplifying these complicated processes to any degree, it is certainly effective to use, as an alternative to the conventional shadow mask, "interchangeable shadow masks" usable interchangeably which have a multiplicity of apertures formed at completely identical positions. Several types of interchangeable mask and the method of production thereof are suggested in the U.S. Pat. Nos. 3,794,873 and 3,909,928 and the Japanese Patent Laid-Open Nos. 16068/72, 7021/71 and 108570/76.

No new method for producing a color picture tube using interchangeable shadow masks nor a method for producing a color picture tube fully utilizing the advantages of the interchangeable shadow masks have so far been developed before the present invention.

SUMMARY OF THE INVENTION

An object of the present invention is to solve the above-mentioned problem points of the prior art and to provide a method for producing a master pattern for manufacture of a color picture tube which is much more simplified and facilitated than the conventional methods by using an interchangeable shadow mask.

In order to achieve this object, there is provided according to the present invention a method for producing a master pattern in which an image of an interchangeable shadow mask is formed on the internal surface of a glass face panel and transferred onto the surface of a photosensitive plate.

DETAILED DESCRIPTION OF THE PREFERRED EMBODIMENTS

Embodiment 1

Figure 1:
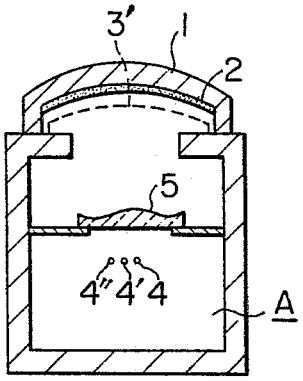
FIG. 1 is a diagram showing a method for exposing the photo-resist film or phosphor film to light in production of a phosphor screen of the color picture tube.
Figure 2:
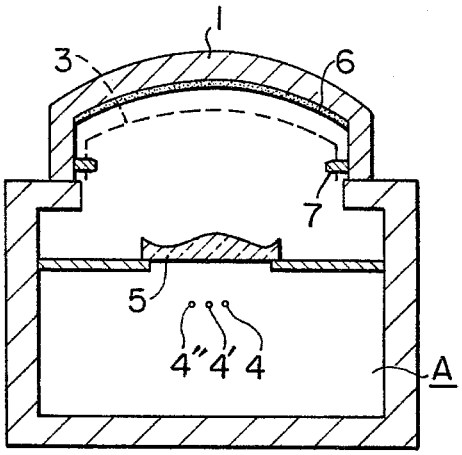
FIGS. 2 to 6, 9 and 10 are diagrams for explaining the method of producing the master pattern according to the present invention.

An example of the method for producing an exposure master pattern used in the present invention is shown in FIG. 2.

In this drawing, the internal surface of a face panel 1 mounted on an exposure mount A is coated with a photosensitive film 6 such as a photographic emulsion containing a silver salt which becomes non-light-permeable or opaque by radiation of light thereon. Further, an interchangeable shadow mask 3 is supported in position on the face panel 1 by means of a support member 7.

Several methods for producing the interchangeable shadow mask have been suggested. One of them consists in adequately annealing the material, generally pure iron, to minimize the strain generated by the press work, thereby providing the interchangeability of the shadow mask.

By using a light source 4, a photosensitive layer 6 is exposed to light to sensitize only the portions of the layer 6 corresponding to the apertures of the interchangeable shadow mask 3 through a compensating lens 5 for compensating for an error between the electron beam path and the path of exposure light in the color picture tube.

After removing the face panel 1 from the exposure mount A, followed by the removal of the interchangeable shadow mask 3, the photosensitive layer 6 is developed and fixed. An image of the apertures of the interchangeable shadow mask 3 is left as an opaque pattern on the internal surface of the face panel 1.

Exposure of the photosensitive layer 6 to light may be effected by the use of an electron beam instead of by visible light or ultraviolet ray. In that case, the compensating lens 5 is of course eliminated.

Figure 3A:
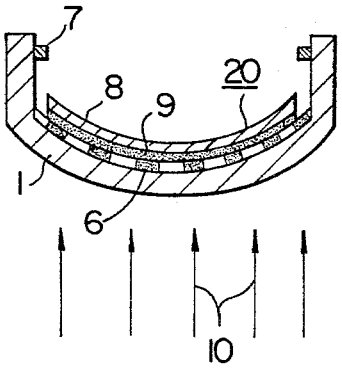

Next, as shown in FIG. 3*a*, photosensitive plate, as hereinafter so called, including a light-permeable or translucent thin plate 8 of glass or plastics with one surface thereof coated with a photosensitive film 9 of such a material as a photographic emulsion like silver salt, which is dried, is arranged in such a manner that the photosensitive film 9 is in close contact with the internal surface of the face panel 1.

Flood light 10 is radiated on the front surface of the face panel 1 thereby exposing the photosensitive film 9 through the opaque pattern. The photosensitive plate is removed from the face panel 1 for development and fixing, so that a pattern with opaque portions corresponding to the image of the opaque pattern is formed on the light-permeable thin plate 8.

The pattern thus formed on the light-permeable thin plate 8 has a transparent portions corresponding to the apertures of the interchangeable shadow mask and the other opaque portions (which relation may be reversed depending on the properties of the photo-resist used), thus producing an exposure master pattern 20 for forming a black matrix or phosphor dots. The master pattern produced by the use of the light source 4 among the three light sources 4, 4' and 4'' corresponds to the phosphor region of one of the three primary colors of red, green and blue, while the master patterns for the phosphor regions of the other two colors may be formed by the use of separate photosensitive plates employing the light from the light sources 4' and 4'' respectively in similar manner. These three master patterns may be used for forming the phosphor regions of red, green and blue. In other words, in order to form the phosphor regions for the three primary colors, the series of processes including coating of phosphor slurry, exposure and development is required to be repeated three times, once for each color. The first master pattern is used for forming the first phosphor regions of, for example, red, and the second and third master patterns for forming the second and third phosphor regions of, for example, green and blue, respectively, in exposing the phosphor film.

In forming a master pattern used for producing a black matrix, exposure of the photosensitive emulsion layer 6 coated on the internal surface of the face panel 1 is effected by using the three light sources 4, 4' and 4'' in sequence, so that an image of all the apertures of the shadow mask 3' in the form of an opaque pattern is formed on the internal surface of the face panel 1.

Subsequently, the photosensitive plate is exposed, developed and fixed by the method described with reference to FIG. 3, thereby forming a master pattern for production of a black matrix to form all the aperture of the shadow mask in the form of transparent or opaque image.

In the above-mentioned methods of producing the master pattern, an image of the interchangeable shadow mask is first formed on the internal surface of the face panel and then transferred onto the photosensitive plate.

The reason for adopting this method is that where the light-permeable thin plate 8 of the photosensitive plate is made of glass, the thickness thereof cannot be ignored. On the other hand, in the case where the photosensitive plate is very thin, so that the thickness thereof may be ignored, as with photographic film, it is possible that, eliminating the process of coating the photosensitive emulsion layer 6 from the processes shown in FIG. 2, the photosensitive plate or photographic film is exposed to light in close contact with the internal surface of the face panel 1. Thus, an image of the interchangeable shadow mask is printed directly on the photosensitive plate thereby to produce a master pattern.

Before forming each master pattern, a reference positioning mark may be inscribed on the internal surface of the face panel, which mark, together with the image of the apertures of the interchangeable shadow mask, is transferred onto the photosensitive plate. By so doing, the master pattern may be very conveniently positioned in producing the color picture tube.

Figure 3B:
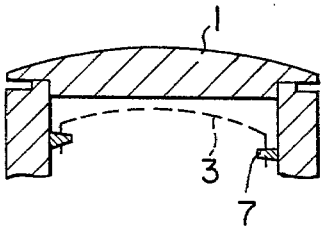

Although the diagrams of FIGS. 2 and 3*a* show the cases where the internal surface of the face panel is curved, the present invention is of course applied with equal effect to a flat internal surface of the face panel as shown in FIG. 3*b*, in which case the master pattern is not curved, thereby greatly facilitating the production and positioning of the master pattern.

A method of producing the phosphor screen of the color picture tube with master patterns will be described below.

A master pattern for forming a black matrix and three master patterns for the three phosphor regions of red, green and blue respectively are produced by the above-mentioned method. Among these master patterns the one for forming the black matrix has transparent portions corresponding to all the phosphor regions of red, green and blue, for example, while each of the three master patterns for forming the red, green and blue phosphor regions has transparent portions corresponding the phosphor regions of the color involved, for example.

Figure 4:
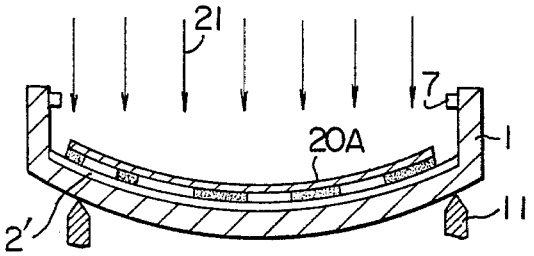

First, a black matrix is formed by the method shown in FIG. 4.

For instance, PVA-ADC photo-resist (photo-resist using ammonium dichromate as a crosslinking agent, and polyvinyl alcohol as a water-soluble polymer) is coated on the internal surface of the face panel 1 and dried thereby to form the phot-resist layer 2'. Various mixing ratios of the PVA-ADC photo-resist may be used, an example being a mixture solution containing 1,000 ml incompletely saponificated polyvinyl alcohol with the polymerization degree as low as approximately 500 to 1500 and 15 g ammonium dichromate.

The face panel 1 is placed on the support mount 11, and the master pattern 20A for forming a black matrix is set on the photo-resist film 2 in such a manner that the optical image carried by the pattern 20A is in close contact with the photo-resist film 2. In the process, the master pattern 20A is placed in position by the use of a guide pin or the positioning reference mark mentioned above.

Flood light 21 is radiated on the photo-resist film 2 through the entire surface of the master pattern 20A. The master pattern 20A is removed and the photo-resist film 2 is developed in hot water. Only those parts of the photo-resist film 2 which are hardened by the radiation of the flood light passing through the transparent part of the master pattern 20A are left.

The assembly is dried and then the whole surface thereof is sprayed with the suspension of colloidal carbon, which is dried. Then, it is treated with such a digestive agent as hydrogen peroxide solution. The hardened photo-resist is melted and removed together with the carbon thereon, so that only the carbon deposited directly on the internal surface of the face panel 1 is left. In this way, a black matrix with holes at those parts corresponding to the phosphor regions is formed.

The phosphor regions of the black matrix are produced by filling phosphor material in the holes thereof in the manner mentioned below.

Three different phosphor slurries comprising, for example, the aqueous solution of PVA-ADC photo-resist containing an appropriate amount of red, blue and green phosphor materials respectively are prepared. One of the slurries containing one of the phosphor materials, for instance, the red phosphor material is coated on the internal surface of the face glass where the black matrix has been formed, and dried. The master pattern for forming the red phosphor regions, which has been produced in this way is set on the face glass as in the case of forming the black matrix. After exposure with flood light, it is developed in water, with result that the red phosphor material is filled in the predetermined holes of the black matrix.

By repeating a similar process for the phosphor slurries containing the green and blue phosphor materials, the green and blue phosphor materials are filled in the predetermined holes of the black matrix. As a result, a phosphor screen of the black matrix of which the spaces between the phosphor regions of the three primary colors are filled with light-absorbing material such as carbon is produced.

As an alternative to the above-mentioned method in which slurries with phosphor materials added to the photo-resist in advance are used for forming the phosphor regions, what is called the powder process may be employed for forming the phosphor regions.

According to the latter method, after forming the black matrix, the photo-resist is coated on the internal surface of the face glass and dried. Then, exposure is effected by flood light through the master pattern for forming, for example, the red phosphor region, thus hardening the photo-resist part corresponding to the red phosphor region. The master pattern is removed and the photo-resist film is developed, so that the unhardened part of the photo-resist is removed with the hardened part thereof left unremoved.

The hardened photo-resist is made to swell by use of such an appropriate solvent as ethyl alcohol or hot water. The red phosphor material is sprayed on and attached to the swollen hardened photo-resist.

The same processes are followed for the green and blue materials thereby to attach the phosphor materials of the three primary colors of red, green and blue to the predetermined positions respectively. They are heated to remove the photo-resist, thus producing the phosphor screen of the color picture tube.

The foregoing description concerns the production of the phosphor screen of the black matrix color picture tube. In the case of forming a phosphor screen without any black matrix, the processes for forming the black matrix among the processes explained above are all eliminated and instead the phosphor regions are formed directly.

Further, although the diagrams of FIGS. 2 and 3 involve the production of the phosphor screen on the curved internal surface of the face glass, the present invention may be applied with equal effect to the flat instead of curved internal surface of the face panel or master pattern.

The apertures of the shadow mask, hence, the holes of the black matrix or the phosphor regions may take any desired shape including stripe, circle and rectangle.

As will be understood from the foregoing explanation, the present invention eliminates the need of exposure through the shadow mask used in the conventional methods, but permits exposure by flood light with the master pattern in close contact with the internal surface of the face panel, for forming the black matrix or phosphor regions.

Accordingly, the shadow mask and the face panel need not be handled as a couple through the entire manufacturing processes, which are thus greatly simplified, while at the same time improving the accuracy of forming the black matrix and the phosphor regions. Further, since the need for an expensive exposure mount having a compensating lens and the spot light sources is eliminated, great advantages including very low-cost production equipment are realized.

Embodiment 2

Another embodiment of the present invention in which the master pattern is formed by radiating the photosensitive plate with electron beams will be described below.

Figure 5:
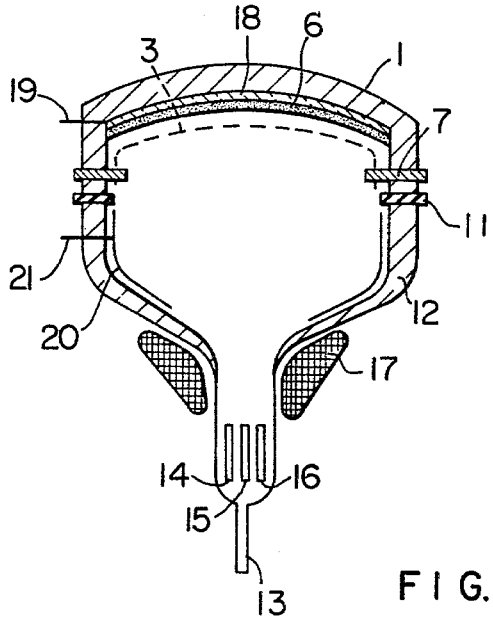
Figure 6A:
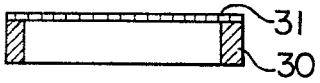
Figure 6B:
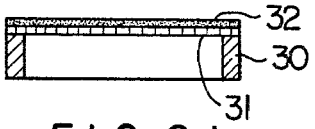
Figure 6C:
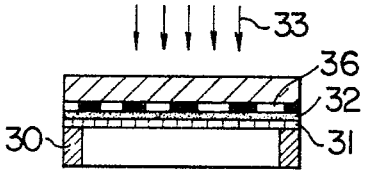
Figure 6D:
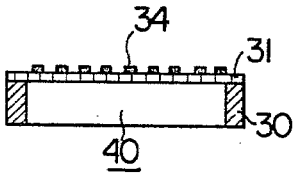

Referring to FIG. 5, the face panel 1 is connected through a vacuum packing 11 to a vacuum exhaust system 12. The internal surface of the face panel 1 is coated with a transparent conductive film 18 and a photosensitive emulsion film 6 containing silver salt. The interchangeable shadow mask 3 is supported in a predetermined position by a support member 7.

The funnel of the color picture tube may be used as the vacuum exhaust system 12 without any change, which is coupled to a vacuum pump (not shown) by a side tube 13 for exhaustion.

The photosensitive emulsion film 6 is coated on the internal surface of the face panel 1, and after being dried, coupled to the exhaustion system 12 in a dark room for exhaustion.

Next, voltages are applied to an external lead wire 19, support member 7 and lead wire 21, so that a transparent conductive film 18, an interchangeable shadow mask 3 and an interior conductive film 20 electrically connected with them, respectively, are impressed with the same voltage as applied in the operation of the color picture tube.

A deflection current identical to that caused in the operation of the color picture tube is made to flow in the deflection coil 17, and electron beams are emitted by using the electron guns 14, 15 and 16 sequentially or simultaneously and focused on the photosensitive emulsion film 6, so that the entire surface of the photosensitive film 6 is scanned by use of the deflection coil 17.

The face panel 1 is removed from the vacuum exhaust system and the photosensitive emulsion film is developed and fixed by the well-known method, with the result that opaque images of the apertures of the interchangeable shadow mask is formed on the photosensitive emulsion film 6. Subsequently, these opaque images of the mask apertures are used to form a master pattern by the same method as Embodiment 1. Further, the black matrix and the phosphor regions are similarly produced, thereby forming the phosphor screen of the black matrix color picture tube.

The feature of this embodiment lies in the fact that, since electron beams are used for forming an image of the interchangeable shadow mask on the internal surface of the face panel as in the case of actual operation of the color picture tube, there is no need for a compensating lens and the phosphor screen is very accurately formed.

Embodiment 3

Instead of the silver salt photosensitive emulsion film 6 coated on the internal surface of the face panel 1 in the above-mentioned two embodiments, PVA-ADC photo-resist may be used as a photosensitive material.

In that case, the PVA-ADC photo-resist is coated on the internal surface of the face panel 1 and, as in embodiment 2, exposed to light to harden the exposed portion thereof. After being developed, the internal surface of the face panel 1 is coated with a colloidal carbon suspension. It is dried and treated with hydrogen peroxide solution, so that the hardened photo-resist is melted and, together with the carbon deposited on the photo-resist, is removed. In other words, a carbon film with holes corresponding to the apertures of the interchangeable shadow mask is formed on the internal surface of the face panel 1. By this method, an image of the carbon film is transferred to a photographic dry plate or photographic film to form a master pattern.

Embodiment 4

According this embodiment, the black matrix and the phosphor regions are formed by a printing process.

First, as shown in FIG. *6a*, a screen 31 of 160 to 400 mesh in size made of thin wires of stainless steel, polyester or Nylon (trade mark) 20 to 50 μm in diameter is supported in tension within a metal frame 30 of aluminum or like material.

Referring to FIG. *6b*, a photo-resist film 32 such as PVA-ADC photo-resist is coated and dried on the screen 31. The master pattern 36 formed by the method shown in Embodiment 1 or 2 is attached closely to the photo-resist film 32 and flood light 33 is radiated on it as shown in FIG. *6c*. The master pattern 36 is removed and the photo-resist film 32 is developed by a normal method. As shown in FIG. *6d*, a printing master pattern 40 with the hardened photo-resist region 34 deposited on the screen 31 is formed.

Depending on whether the photo-resist film 32 deposited in the process described with reference to FIG. *6b* is negative or positive, the photo-resist film portions corresponding to the apertures of the shadow mask are hardened or removed by development respectively. Thus, by appropriately selecting a negative or positive photo-resist, a printing master pattern for forming the black matrix or phosphor regions is produced.

Figure 7:
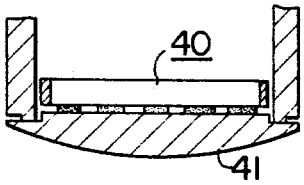
FIGS. 7 and 8 are diagrams showing embodiments of the invention for producing the phosphor screen of a color picture tube by use of the master pattern according to the invention.
Figure 8A:
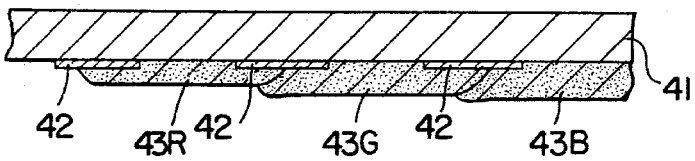
Figure 8B:
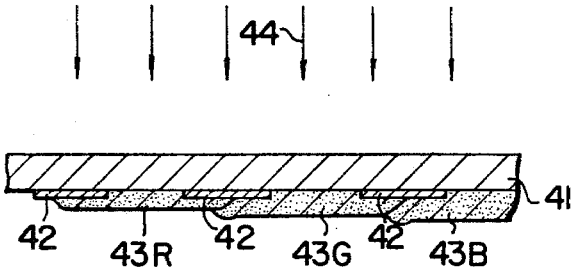

The printing master pattern 40 thus obtained (for forming the black matrix) is closely attached to the internal surface of the face panel 41 as shown in FIG. 7. The printing ink containing high-viscosity collodial carbon or like material is applied to the internal surface of the face glass 41 with a brush or roll through the printing master pattern 40.

The printing master pattern 40 is removed and the printing ink film is dried, so that a black matrix with holes corresponding to the phosphor regions is produced.

In order to form the phosphor regions, the printing master pattern and the printing ink for forming the phosphor regions are used for the colors of red, blue and green respectively in similar manner to the black matrix production. Printing inks of various compositions may be used for forming the phosphor regions, but preferable results are obtained by using a printing ink in paste form comprising such a bonding agent as polyvinyl alcohol, cellulose acetate or acryl resin with phosphor powder dispersed therein.

Embodiment 5

In the case where the phosphor regions are formed by the printing process as shown in Embodiment 4, adjacent phosphor regions 43R, 43G and 43B may sometimes be overlapped on each other due to the "loosening" of the printing paste, as shown in FIG. *8a*. The effect of this phenomenon is reduced remarkably by the black matrix 42, as such an object is achieved by the present embodiment.

Photo-resist such as PVA-ADC photo-resist with phosphor powder dispersed therein may be used as the printing ink for forming the phosphor regions, thereby forming the phosphor regions 43R, 43G and 43B and the black matrix 42 by the method mentioned with reference to Embodiment 4.

As in the manner shown in FIG. *8b*, flood light 44 is radiated on the outside of the face panel 41, with the result that only the portions of the photo-resist of the phosphor regions 43R, 43G and 43B which are not deposited with any black matrix 42 is hardened, while the portions thereof deposited with the black matrix 42 are not hardened. After exposure by the flood light, normal development is effected, so that the phosphor material covered on the black matrix 42 is removed thereby to eliminate the overlapped conditions of the adjacent phosphor materials, thus producing a high quality phosphor screen.

In Embodiment 4 and the embodiment under consideration, the black matrix and the phosphor regions are both formed by the printing method. It is of course possible to produce one of them by the optical method shown earlier and the other by the printing method.

Embodiment 6

Figure 9:
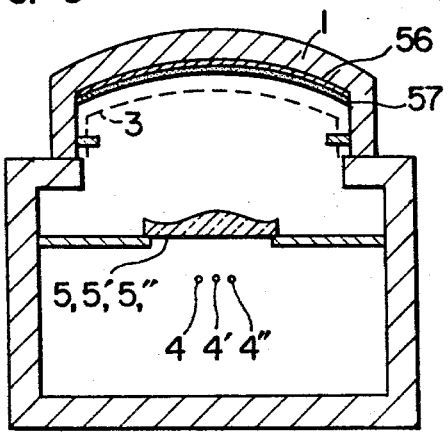

As shown in FIG. 9, a vacuum evaporated copper film 56 several hundreds to one thousand Å thick and a PVA-ADC photo-resist film 57 several to ten-odd μm thick are overlapped and laid on the internal surface of the face panel 1. On this assembly, the interchangeable shadow mask 3 is fixed, the whole assembly being set on the exposure mount in the same manner as shown in Embodiment 1.

First, the photo-resist film 57 is exposed to light from the light source 4 through the interchangeable shadow mask 3, and after removing the interchangeable shadow mask, developed in hot water 40° C. to 50° C. in temperature. Only the photo-resist corresponding to the phosphor regions of one of the three primary colors is hardened by exposure, while the other unexposed portions are melted away.

Next, the copper film 56 is etched by ferric chloride solution of about 40 Be', with the result that the portions of the copper film covered on the hardened photo-resist are left unremoved, while the other portions of the copper film are melted off.

The remaining hardened photo-resist on the copper film is removed with such an etching agent as hydrogen peroxide solution. Thus, a negative pattern with copper deposited only on the portions of the internal surface of the face panel 1 which correspond to the phosphor regions of one of the three primary colors is produced.

Figure 10:
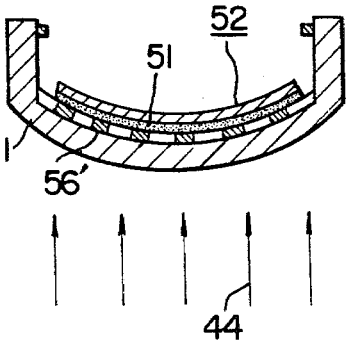

As shown in FIG. 10, the photosensitive plate 52 is arranged in such a way that the photosensitive film 51 is in close contact with the negative pattern 56', and flood light 44 is radiated on the outside of the face panel 1. The photosensitive plate 52 is removed and developed and fixed. A master pattern for forming the phosphor regions of one of the three primary colors is obtained.

The other light sources 4' and 4'' are also used for similar processes to produce two master patterns used for forming the phosphor regions of the other two colors respectively. One photo-resist film 57 is exposed to light from the three light sources 4, 4' and 4'' sequentially or continuously, followed by similar processes, thereby producing a master pattern for forming a black matrix.

In each of these cases, a photographic emulsion of silver bromide is used as the material of the photosensitive film 51 coated on the photosensitive plate 52, a master pattern with the transparent portions corresponding to the apertures of the interchangeable shadow mask (i.e., the portions corresponding to the phosphor regions) and the remaining opaque portions. The transparent and opaque portions are of course reversed by using a positive photosensitive material for the photosensitive film 51.

Instead of copper used as the material of the metal film 56 in the embodiment under consideration, at least one of chromium, molybdenum, aluminum, gold and silver may be used. Various etching solutions may be used for etching the metal films of these metal, typical ones being a mixture solution of phosphoric acid and nitric acid for aluminum and molybdenum, alkali aqueous solution of red prussiate of potash or ammonium solution of cerium (IV) nitrate for chromium, and aqueous solution of ammonium iodide for gold. For the photo-resist film 57, various photo-resists of positive and negative types including KOKAK's KPR (trade mark) and Shipley's AZ-111 (trade mark) may be used in place of PVA-ADC photo-resist. Further, it is of course possible to use electron beams instead of light rays for exposure of these types of photo-resists.

A transparent thin plate of glass, plastics or like material coated with a photosensitive film is not the only choice for the photo-sensitive plate 52, but a photosensitive film coated on the mesh is an alternative, so that the phosphor regions and the black matrix may be formed either by photographic or printing method, as mentioned earlier.

I claim:

1. A method for producing a master pattern, to be used for forming a coating on the internal surface of a glass face panel of a color picture tube phosphor screen, comprising steps of:

(a) using said glass face panel of a color picture tube having two opposed surfaces, an internal surface and an external surface, the internal surface of said glass face panel being adapted to have a coating formed thereon, forming an image of at least part of an interchangeable shadow mask on the internal surface of the glass face panel;

(b) arranging a photosensitive plate in such a manner that a photosensitive film of said photosensitive plate is in close contact with said image of said interchangeable shadow mask formed on said internal surface of said face panel;

(c) exposing said photosensitive plate by directing flood light from the outside of said face panel through said external and internal surfaces and through said image; and (d) forming said image on said photosensitive plate by developing and fixing said photosensitive plate, whereby a master pattern for forming said coating on the internal surface of said glass face panel is formed.

2. A method for producing a master pattern according to claim 1, in which said photosensitive film of said photosensitive plate is a photographic emulsion film containing silver halide.

3. A method for producing a master pattern according to claim 1, in which said photosensitive plate comprises said photosensitive film covered on a transparent thin plate.

4. A method for producing master pattern according to claim 1, in which said photosensitive plate comprises said photosensitive film deposited on a mesh.

5. A method for producing a master pattern according to claim 1, in which said image of said interchangeable shadow mask formed on said internal surface of said face glass panel is produced by following the steps of:

(a) coating a photosensitive film on said internal surface of said face panel;

(b) exposing said photosensitive film on said internal surface to light through said interchangeable shadow mask; and (c) forming an image of said interchangeable shadow mask on said internal surface of said face panel by developing and fixing said photosensitive film on said internal surface.

6. A method for producing a master pattern according to claim 5, in which said photosensitive film on said internal surface is a photographic emulsion film containing silver halide.

7. A method for producing a master pattern according to claim 5, in which said exposure of the photosensitive film is effected by using one light source.

8. A method for producing a master pattern according to claim 5, in which said exposure of the photosensitive film is effected by using three light sources, one at a time.

9. A method for producing a master pattern according to claim 5, wherein, in producing said image of said interchangeable shadow mask on said internal surface of said face glass panel, said interchangeable shadow mask is positioned adjacent said photosensitive film on said internal surface after coating the photosensitive film on said internal surface of the glass panel and before exposing the photosensitive film on the internal surface to light.

10. A method for producing a master pattern according to claim 1, wherein said image of at least part of an interchangeable shadow mask formed on the internal surface of the glass face panel is opaque.

11. A method for producing a master pattern according to claim 1, wherein said image of said at least part of the interchangeable shadow mask is an image corresponding to one of the red, blue and green phosphor regions where, respectively, the red, blue and green phosphor materials of the color picture tube are to be positioned, or corresponding to all of the regions where the red, blue and green phosphor materials are to be positioned, whereby a master pattern for forming, respectively, one of the red, blue or green phosphor regions, or a black matrix, of the color picture tube phosphor screen is formed.

12. A method for producing a master pattern according to claim 11, wherein said image is an image corresponding to the region where one of the red, blue or green phosphor materials regions is to be positioned, whereby a master pattern for forming one of the red, blue or green regions of the color picture tube phosphor screen is formed.

13. A method for producing a master pattern according to claim 11, wherein said image is an image corresponding to all of the regions where the red, blue and green phosphor materials are to be positioned, whereby a master pattern for forming a black matrix of the color picture tube phosphor screen is formed.

14. A method for forming a master pattern according to claim 1, wherein, prior to exposing said photosensitive plate, a reference positioning mark is inscribed on the internal surface of said glass face panel, which mark, together with the image of at least part of the interchangeable shadow mask, is transferred onto the photosensitive plate during said exposing and said forming steps, whereby the master pattern may be easily positioned in forming the coating on the internal surface of the glass face panel.

15. A method for forming a master pattern according to claim 5, in which said exposure of the photosensitive film is effected by using three light sources simultaneously.

16. A method for producing a master pattern according to claim 5, wherein said image of at least part of an interchangeable shadow mask formed on the internal surface of the glass face panel is opaque.

17. A method for producing a master pattern according to claim 11, wherein said image of at least part of the interchangeable shadow mask is opaque.

* * * * *